US006216914B1

(12) United States Patent
Martucci

(10) Patent No.: US 6,216,914 B1
(45) Date of Patent: Apr. 17, 2001

(54) BEER DISPENSING SYSTEM

(76) Inventor: Frank J. Martucci, 2635 Boundary La., Bellmore, NY (US) 11710

( * ) Notice: Subject to any disclaimer, the term of this patent is extended or adjusted under 35 U.S.C. 154(b) by 0 days.

(21) Appl. No.: 09/385,593

(22) Filed: Aug. 30, 1999

(51) Int. Cl.[7] ..... B67D 13/00
(52) U.S. Cl. ..... 222/78; 222/400.8; 222/529
(58) Field of Search ..... 222/25–28, 14, 222/16, 17, 40, 71, 74, 78; 251/331, 334; 446/8

(56) References Cited

U.S. PATENT DOCUMENTS

| | | | | |
|---|---|---|---|---|
| 1,738,181 | * | 12/1929 | Gastman | 222/78 |
| 2,093,849 | * | 9/1937 | Renfrew | 222/14 |
| 4,531,654 | * | 7/1985 | Guyon | 222/78 |
| 5,449,144 | * | 9/1995 | Kowalics | 251/99 |
| 5,470,044 | * | 11/1995 | Chi | 251/98 |
| 5,577,538 | * | 11/1996 | Sunderhaus et al. | 141/94 |
| 5,771,778 | * | 6/1998 | MacLean, IV | 99/323.6 |
| 6,073,835 | * | 6/2000 | Ramadan | 235/78 |

* cited by examiner

*Primary Examiner*—Gregory L. Huson
*Assistant Examiner*—Melvin Cartagena

(57) ABSTRACT

Disclosed is a new and improved dispensing system for dispensing fluid through an ornate system. The system has a housing with an upper end, a lower end, a front wall, a rear wall and opposed side walls. Further, the housing has a hollow interior, the lower end having an outwardly extending stand secured thereto. A fluid container is secured within the hollow interior with a cover removably coupled and with an open upper end thereof. An outlet hose extends outwardly of the container with an interior end in fluid communication with the fluid in the container. The outlet hose has an exterior end extending outwardly of one of the opposed side walls of the housing. An outlet pump is coupled with the exterior end of the outlet hose with a dispensing spout contiguous therewith, the outlet pump including a generally U-shaped handle extending downwardly therefrom. The outlet pump also includes a one-way valve pivotally disposed therein for precluding the flow of fluid therethrough. The outlet pump further includes a manipulating handle pivotally coupled with the U-shaped handle, the manipulating handle having an inwardly extending portion for selectively raising the one way valve. Lastly provided as a component of the system of the present invention is a flow counting system.

8 Claims, 9 Drawing Sheets

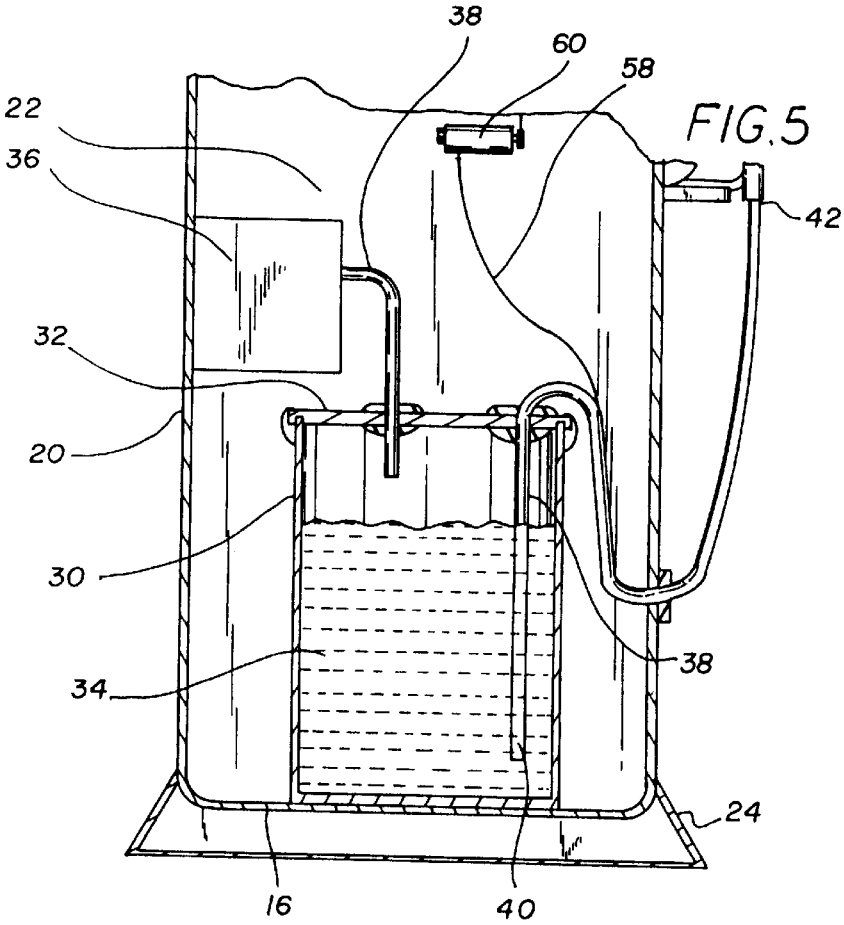
FIG. 5
FIG. 6
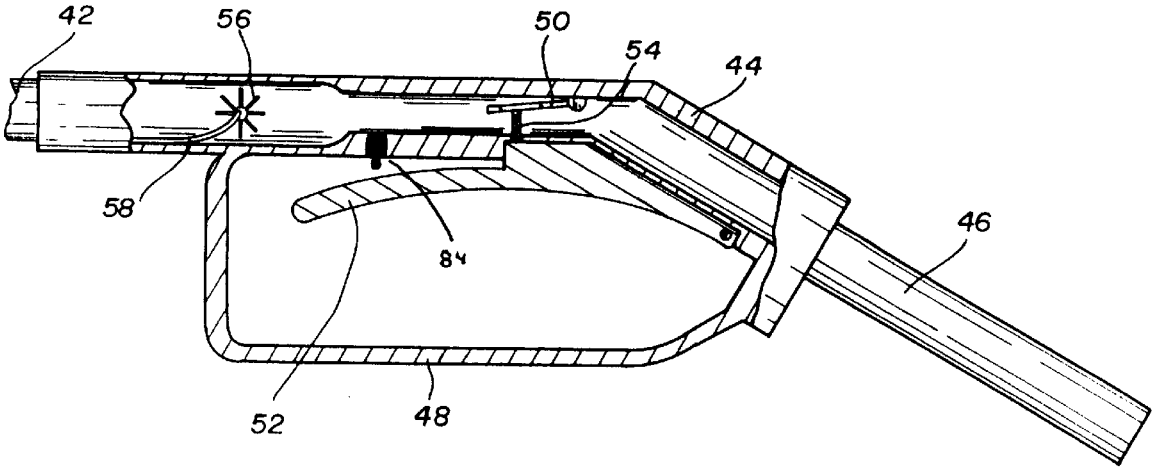

FIG 6A
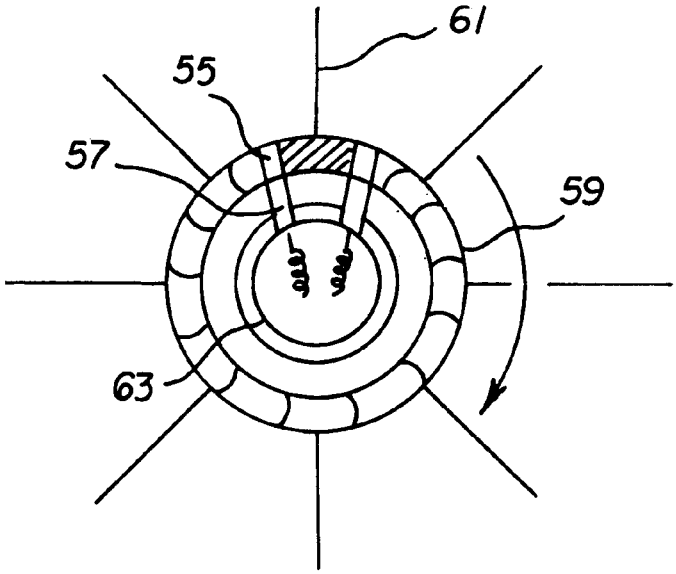
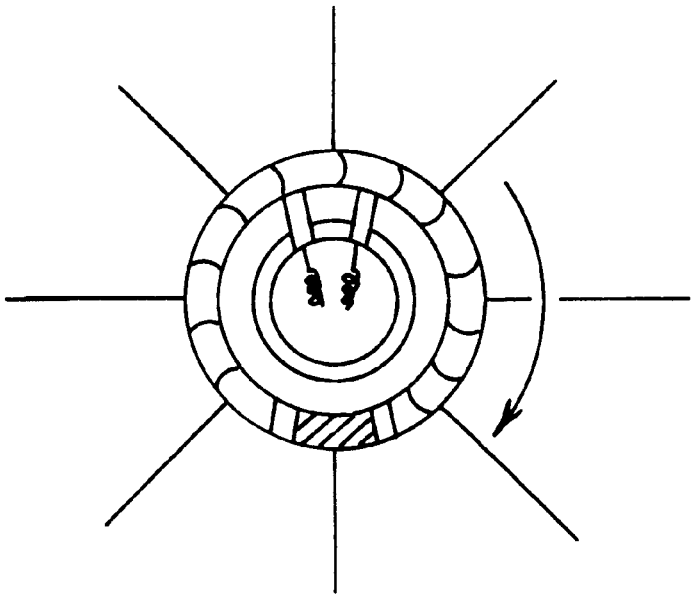
FIG 6B

FIG 7
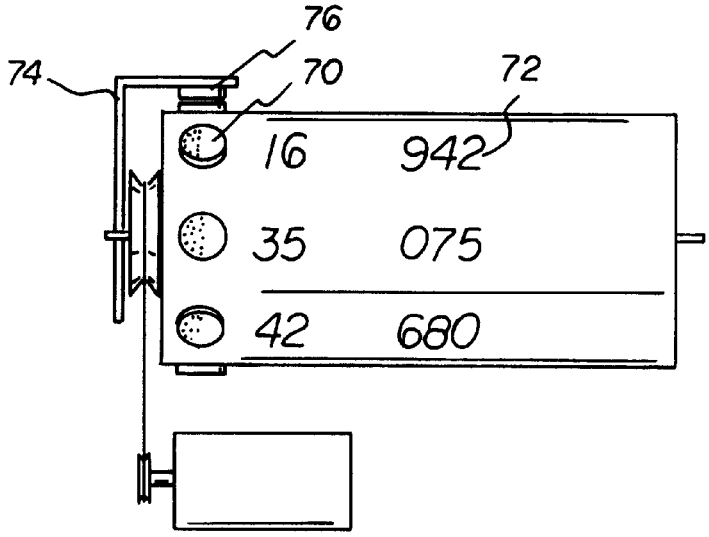
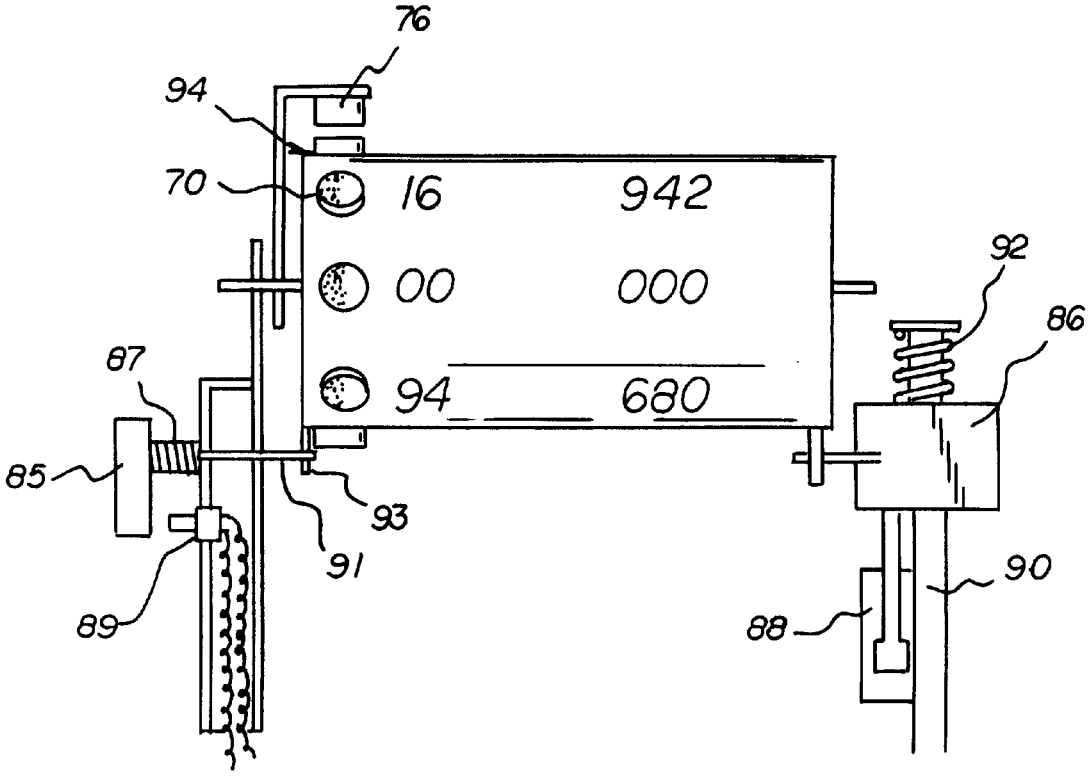
FIG 8

BEER DISPENSING SYSTEM

BACKGROUND OF THE INVENTION

1. Field of the Invention

The present invention relates to a beer dispensing system and more particularly pertains to dispensing beer through an ornate system utilizing a nostalgic, old-style gas pump housing.

2. Description of the Prior Art

The use of beverage dispensers is known in the prior art. More specifically, beverage dispensers heretofore devised and utilized for the purpose of dispensing carbonated beverages are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,303,845 to Osawa; U.S. Pat. No. 5,282,561 to Mihalich; U.S. Pat. No. Des. 278,921 to Nagode; U.S. Pat. No. 5,363,889 to Simpson et al.; U.S. Pat. No. 4,055,692 to Zionts et al., U.S. Pat. No. 4,113,153 to Wellman; U.S. Pat. No. 4,030,634 to Osborn, issued Jun. 21, 1977, discloses a bottled water transfer device; U.S. Pat. No. 3,428,218 to Coja, issued Feb. 18, 1969, discloses a liquid dispenser for plural, mixed beverages from the original bottles; U.S. Pat. No. 2,565,084 to Parks, issued Aug. 21, 1951, discloses a coin or check controlled liquid dispensing apparatus having directive indicators; U.S. Pat. No. 2,117,750 to Svenson, issued May 17, 1938, discloses a liquid handling mechanism; and U.S. Pat. No. 1,246,804 to Edmundson, issued Nov. 13, 1917, discloses an apparatus for dispensing beverages.

While these devices fulfill their respective, particular objective and requirements, the aforementioned patents do not describe a beer dispensing system for dispensing beer through an ornate system utilizing a nostalgic, old-style gas pump housing.

In this respect, the beer dispensing system according to the present invention substantially departs from the conventional concepts and designs of the prior art, and in doing so provides an apparatus primarily developed for the purpose of dispensing beer through an ornate system.

Therefore, it can be appreciated that there exists a continuing need for new and improved beer dispensing system which can be used for dispensing beer through an ornate system. In this regard, the present invention substantially fulfills this need.

SUMMARY OF THE INVENTION

In the view of the foregoing disadvantages inherent in the known types of beverage dispensers now present in the prior art, the present invention provides an improved beer dispensing system. As such, the general purpose of the present invention, which will be described subsequently in greater detail, is to provide a new and improved beer dispensing system and method which has all the advantages of the prior art and none of the disadvantages.

To attain this, the present invention essentially comprises a housing having an upper end, a lower end, a front wall, a rear wall and opposed side walls. The housing has a hollow interior. The lower end has an outwardly extending stand secured thereto. The front wall has a display disposed thereon. The upper end has a decorative sign extending upwardly therefrom. A beverage container is secured within the hollow interior of the housing. The beverage container has a cover removably coupled with an open upper end thereof. The beverage container holds a quantity of a carbonated beverage therein. A pump is secured within the hollow interior of the housing. The pump has a tube extending outwardly therefrom and extends inwardly through the cover into the beverage container. An outlet hose extends outwardly of the beverage container. The outlet hose has an interior end in fluid communication with the carbonated beverage in the beverage container. The outlet hose has an exterior end extending outwardly of one of the opposed side walls of the housing. An outlet pump is coupled with the exterior end of the outlet hose. The outlet pump includes a dispensing spout contiguous therewith. The outlet pump includes a generally U-shaped handle extending downwardly therefrom. The outlet pump includes a one way valve pivotally disposed therein for precluding the flow of carbonated beverage therethrough. A manipulating handle is pivotally coupled with the U-shaped handle. The manipulating handle has an inwardly extending portion for selectively raising the one way valve. A flow counting system includes a flow counter wheel disposed within the outlet pump. The flow counter wheel has a wire extending along the outlet hose into the hollow interior of the housing. The flow counting system includes a motor disposed within the hollow interior of the housing. The motor couples with a free end of the wire. The motor being in communication with a power source. The motor has a rotating pulley coupled thereto. The flow counting system includes a flow counter display disposed above the motor whereby the flow counter display is viewable through the display in the front wall of the housing. The flow counter display has a rotating pulley. A band extends between the rotating pulleys of the motor and the flow counter display.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved beer dispensing system which has all the advantages of the prior art beverage dispensers and none of the disadvantages.

It is another object of the present invention to provide a new and improved beer dispensing system which may be easily and efficiently manufactured and marketed.

It is a further object of the present invention to provide a new and improved beer dispensing system which is of durable and reliable construction.

An even further object of the present invention is to provide a new and improved beer dispensing system which is susceptible of a low cost of manufacture with regard to both materials and labor, and which accordingly is then susceptible of low prices of sale to the consuming public, thereby making such a beer dispensing system economically available to the buying public.

Even still another object of the present invention is to provide a new and improved beer dispensing system for dispensing beer through an ornate system.

Lastly, it is an object of the present invention to provide a new and improved dispensing system for dispensing fluid through an ornate system. The system has a housing with an upper end, a lower end, a front wall, a rear wall and opposed side walls. Further, the housing has a hollow interior, the lower end having an outwardly extending stand secured thereto. A fluid container is secured within the hollow interior with a cover removably coupled and with an open upper end thereof. An outlet hose extends outwardly of the container with an interior end in fluid communication with the fluid in the container. The outlet hose has an exterior end extending outwardly of one of the opposed side walls of the housing. An outlet pump is coupled with the exterior end of the outlet hose with a dispensing spout contiguous therewith, the outlet pump including a generally Ushaped handle extending downwardly therefrom. The outlet pump also includes a one-way valve pivotally disposed therein for precluding the flow of fluid therethrough. The outlet pump further includes a manipulating handle pivotally coupled with the U-shaped handle, the manipulating handle having an inwardly extending portion for selectively raising the one way valve. Lastly provided as a component of the system of the present invention is a flow counting system.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a front view of the housing of the present invention shown in cross-section.

FIG. 6 is a cross-sectional view of the dispensing pump of the present invention.

FIGS. 6A and 6B are further enlarged details of the water wheel/impeller shown in FIG. 6.

FIG. 7 is a front view of the cylindrical counter display of the present invention.

FIG. 8 is a front view of the cylindrical counter display but constructed in accordance with an alternate embodiment of the invention.

FIG. 13 is a view similar to FIG. 12 but including a solenoid beverage dispensing valve.

The same reference numerals refer to the same parts through the various figures.

DESCRIPTION OF THE PREFERRED EMBODIMENT

Figure 1:
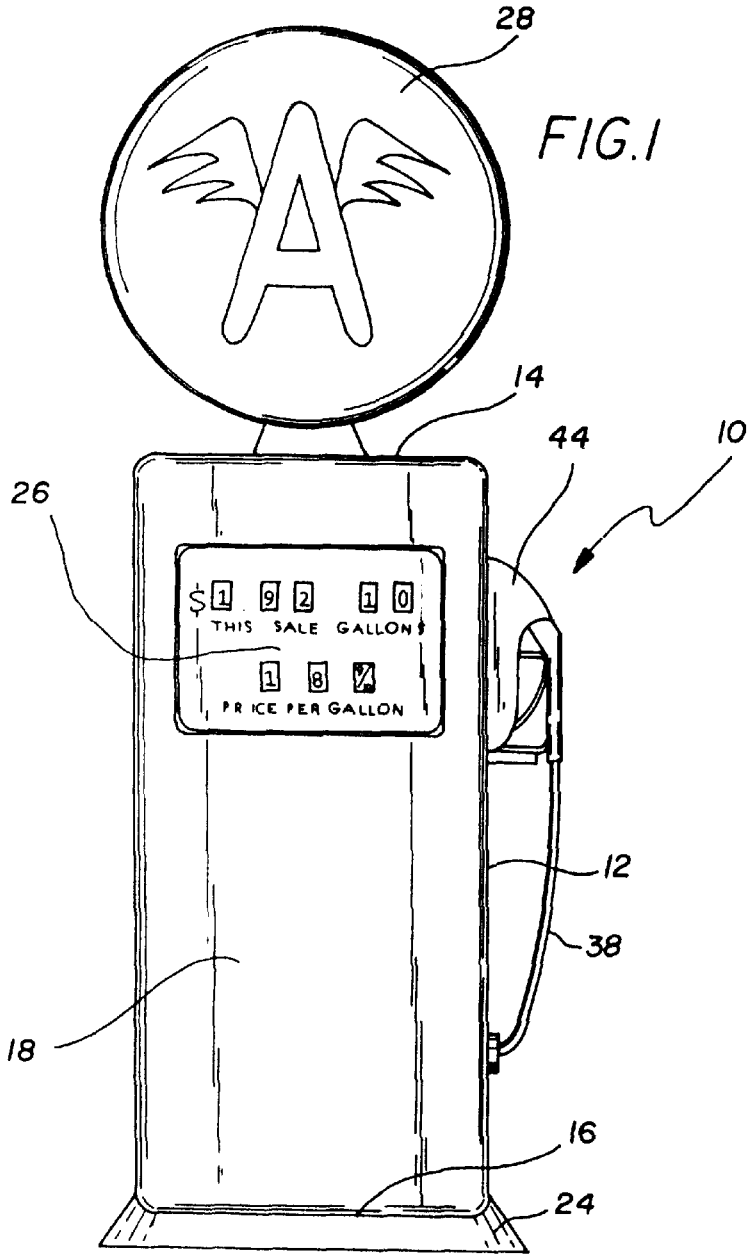
FIG. 1 is a front view of the preferred embodiment of the beer dispensing system constructed in accordance with the principles of the present invention.
Figure 2:
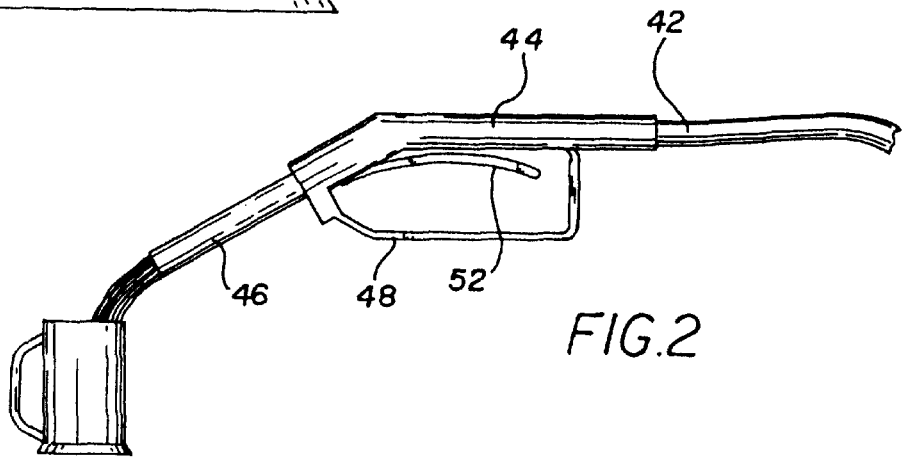
FIG. 2 is a side view of the dispensing pump of the present invention.
Figure 3:
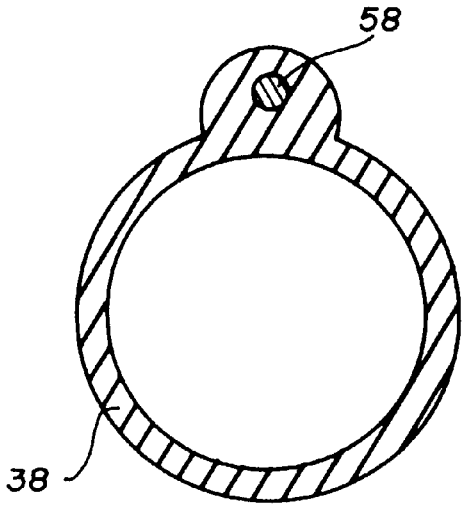
FIG. 3 is a cross-sectional view of the hose of the present invention.
Figure 4:
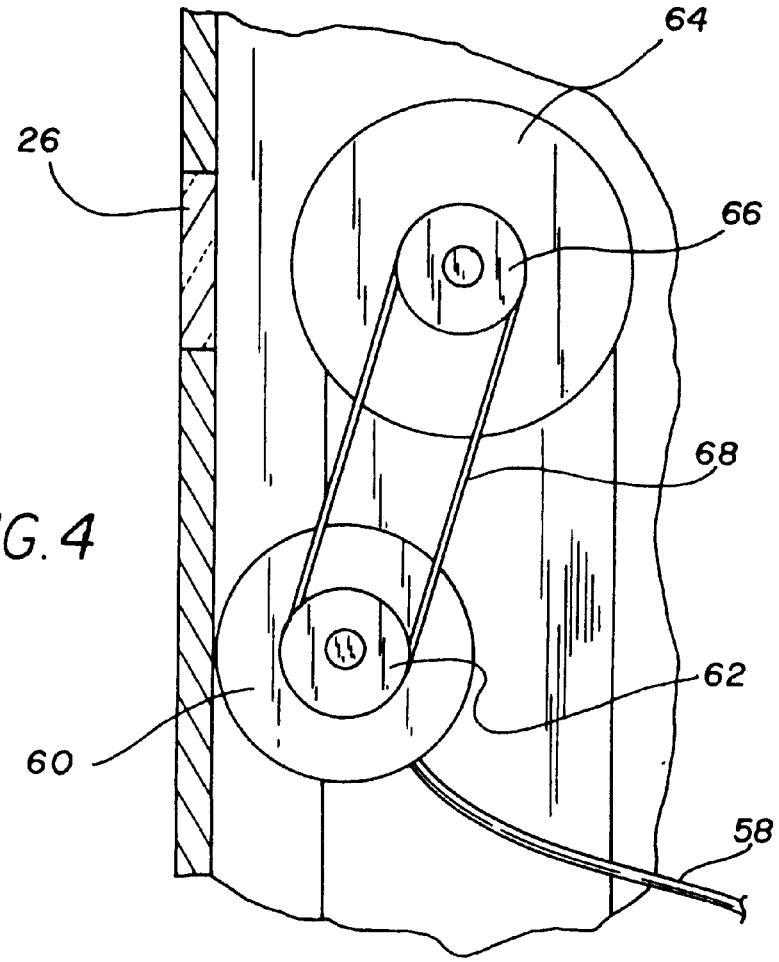
FIG. 4 is a side view illustrating internal components of the housing of the present invention.

With reference now to the drawings, the preferred embodiment of the new and improved beer dispensing system embodying the principles and concepts of the present invention and generally designated by the reference number 10 will be described.

Specifically, it will be noted in the various Figures that the device relates to a beer dispensing system for dispensing beer through an ornate novelty gas-pump style dispenser. In its broadest context, the device consists of a housing, a beverage container, a pump, an outlet hose, an outlet pump and a flow counting system. Such components are individually configured and correlated with respect to each other so as to attain the desired objective.

The housing 12 has an upper end 14, a lower end 16, a front wall 18, a rear wall and opposed side walls 20. The housing 12 has a hollow interior 22. The lower end 16 has an outwardly extending stand 24 secured thereto. The front wall 18 has a display 26 disposed thereon. The upper end 14 has a decorative sign 28 extending upwardly therefrom. The housing is shaped in the form of an old gasoline pump.

The beverage container 30 is secured within the hollow interior 22 of the housing 12. The beverage container 30 has a cover 32 removably coupled with an open upper end thereof. The beverage container 30 holds a quantity of a carbonated beverage 34 therein. The preferred beverage 34 is beer of a predetermined quantity. A refrigeration system could also be incorporated into the beverage container to maintain the coldness of the beer or other carbonated beverage.

The pump 36 is secured within the hollow interior 22 of the housing 12. The pump 36 has a tube 38 extending outwardly therefrom and extends inwardly through the cover 32 into the beverage container 30. The pump 36 serves to produce air into the beverage container 30 to allow the beer or other carbonated beverage to be drawn out of the container 30.

The outlet hose 38 extends outwardly of the beverage container 30. The outlet hose 38 has an interior end 40 in fluid communication with the carbonated beverage 34 in the beverage container 30. The outlet hose 38 has an exterior end 42 extending outwardly of one of the opposed side walls 20 of the housing 12. The outlet hose 38 serves to transport the carbonated beverage 34 outwardly of the beverage container 30.

The outlet pump 44 is coupled with the exterior end 42 of the outlet hose 38. The outlet pump 44 includes a dispensing spout 46 contiguous therewith. The outlet pump 44 includes a generally U-shaped handle 48 extending downwardly therefrom. The outlet pump 44 includes a one way valve 50 pivotally disposed therein for precluding the flow of carbonated beverage 34 therethrough. A manipulating handle 52 is pivotally coupled with the U-shaped handle 48. The manipulating handle 52 has an inwardly extending portion 54 for selectively raising the one way valve 50 to allow the flow of beer or other carbonated beverage through the outlet pump 44 to be dispensed out of the dispensing spout 46.

The flow counting system includes a flow counter wheel 56 disposed within the outlet pump 44. The flow counter wheel 56 has a wire 58 extending along the outlet hose 38 into the hollow interior 22 of the housing 12. The flow counting system includes a motor 60 disposed within the hollow interior 22 of the housing 12. The motor being in communication with a power source. The motor 60 couples with a free end of the wire 58. The motor 60 has a rotating pulley 62 coupled thereto. The flow counting system includes a flow counter display 64 disposed above the motor 60 whereby the flow counter display 64 is viewable through the display 26 in the front wall 18 of the housing 12. The flow counter display 64 has a rotating pulley 66. A band 68 extends between the rotating pulleys 62,66 of the motor 60 and the flow counter display 64. Once beer flows through the outlet tube 38, the beer will cause the rotation of the flow counter wheel 56 with a signal transmitted via the wire 58 to activate the motor 60. The motor 60 will activate the rotating pulley 62 which will cause the rotating pulley 66 of the flow counter display 64 to rotate via the band 68. The flow counter display 64 will be visualized through the display 26 for viewing by a user.

FIGS. 6A and 6B show the flow counter wheel in greater detail. When the fluid flows through the tube it rotates the wheel 56. Note the direction of the arrows for the linear flow of the fluid and the rotational flow of the water wheel. In association therewith is a rotating metal contact 55 with spaced fixed contacts 57. The impeller 59 is at the base of the blades 61. FIG. 6A shows the contacts on position with the insulated pivot 63 upon which the impeller rotates. FIG. 6B is similar to the showing of FIG. 6A but illustrates the contacts in an off position. Further details of this type of a system can be found in U.S. Pat. No. 5,303,845 issued Apr. 19, 1994 to Osawa, the subject matter of which is incorporated herein by reference.

In the preferred embodiment, the cylindrical flow counter display has a plurality of magnets 70 situated about the periphery thereof. As shown in FIG. 7, each magnet has a numeral 72 situated adjacent thereto. Further, all of the magnets reside in a common vertical plane. Also provided is an inverted L-shaped arm 74 fixed with respect to the housing with a magnet 76 mounted to an end thereof. The magnet of the arm is situated within the plane associated with the remaining magnets and is further spaced therefrom as they are rotated coincidentally with the flow counter display. As such, the cylinder is adapted to stop rotating when at least one of the numerals is in line with the display of the housing.

Figure 9:
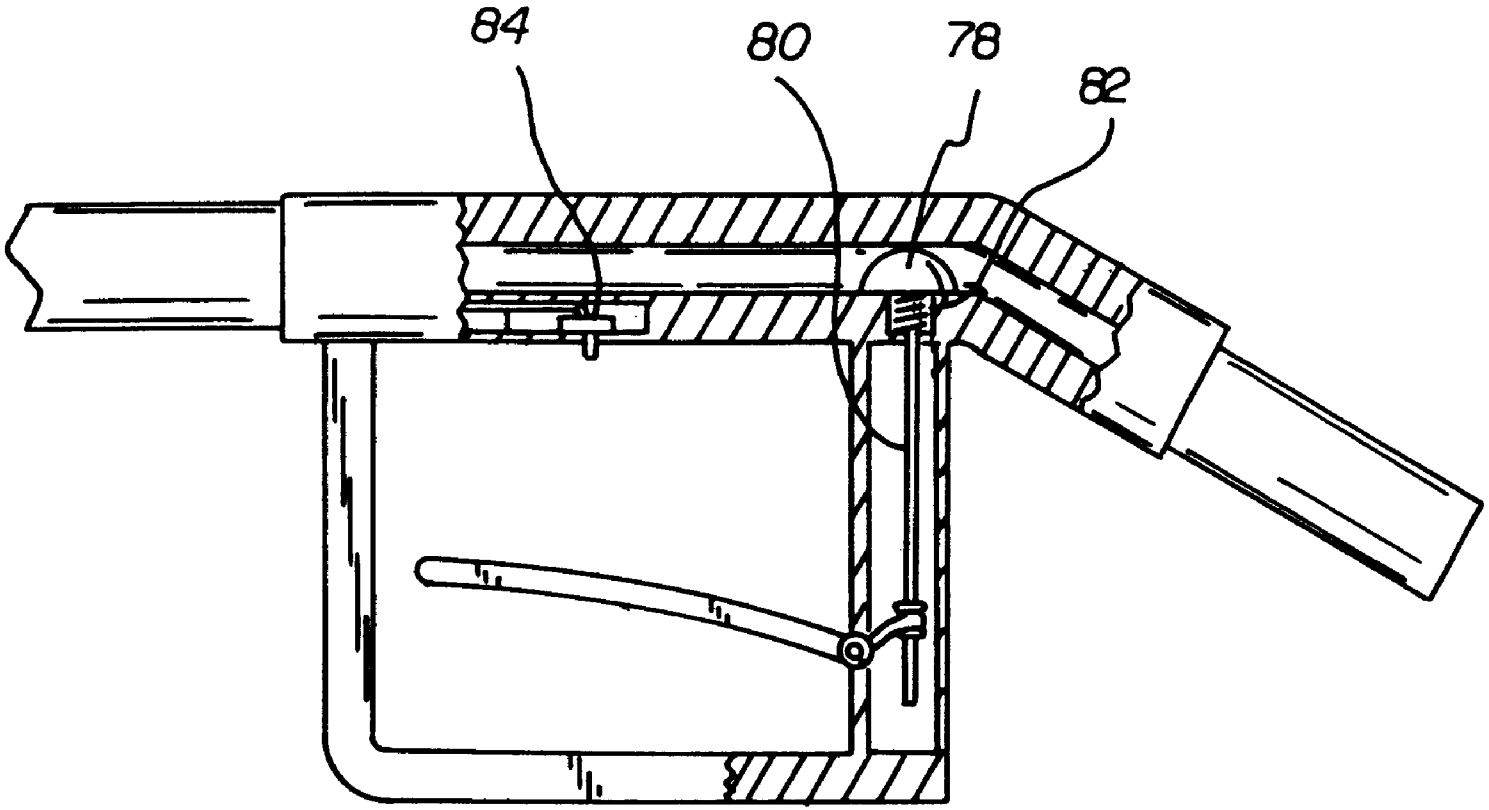
FIG. 9 is a side view partially in cross section similar to FIG. 6 but for an alternate embodiment.

In an alternate embodiment, as shown in FIGS. 8 and 9, the outlet pump is equipped with a hollow deformable elastomeric dome-shaped valve 78 mounted therein for precluding the flow of beer therepast while in an unbiased rest orientation. Connected to an inner top surface of the valve is an actuator rod 80 which depends downwardly into an interior of the U-shaped handle. The manipulating handle, in the present embodiment, is pivotally coupled to the U-shaped handle adjacent a lower end of the actuator rod. The manipulating handle is operatively coupled to the actuator rod such that upon the manipulating handle being selectively raised, the dome-shaped valve is biased downwardly thereby allowing the beer to pass to the dispensing spout. A spring 82 aids the resiliency of the dome-shaped valve in regaining its normal shape and size when the manipulating handle is released.

Also in the present embodiment is a momentary switch 84 situated on the outlet pump above the manipulating handle. The switch is adapted to be depressed when the manipulating handle is selectively raised thereby generating an activation signal. Such activation signal is subsequently transmitted to both a motor 86 and a solenoid 88, as shown in FIG. 8. It should be noted that such components replace the pulleys of the previous embodiment. As shown in FIG. 8, the motor is slidably mounted on a post 90 and is urged downwardly by way of a spring 92. The solenoid is situated beneath the motor for biasing the spring and forcing the motor upwardly so that a rotor wheel abuts a periphery of the flow counter display upon the receipt of the activation signal. While receiving the activation signal, the motor is adapted to spin the flow counter display. Once the activation signal is no longer received, the motor is lowered and deactivated thereby allowing the magnets of the present invention to stop the rotation of the flow counter display at a proper orientation. As such, the flow counter display lacks any calculating accuracy in the present embodiment. Instead, the flow counter offers a novelty and is allowed to spin more freely after the motor is deactivated.

With regard to the reset mechanism shown on the left side of FIG. 8, it is assumed that the nozzle has just been used to dispense fluid causing the display to rotate to a line of numbers other than zero. To reset the counter display to zero, first the reset button 85 is depressed, biasing the reset spring 87 causing the momentary switch 89 on the support to operate the motor and solenoid which spins the display cylinder. Since the reset rod 91 is attached to the reset button, the reset rod is moved outwardly where it contacts the stop pin 93 attached to the spinning display cylinder, stopping it at zero.

After the display cylinder is stopped at zero, the reset button is released which causes the motor to release itself from the display cylinder and the reset rod is forced back away from the stop pin by the reset spring. Once the reset rod is disengaged from the stop pin, the display once again is ready to be moved by the switch on the gas pump nozzle.

It should be noted that while the display cylinder is freewheeling after the release of the motor when actually dispensing beer, the cylinder will eventually stop spinning when one of the magnets along its periphery overcomes the momentum of the spinning cylinder and brings it to rest on a line of numerals. There is a chance that the display would stop at zero. In order to overcome the unrealistic appearance of this novelty motion, the display stopping at zero, a non-magnetic weight 94 would be used in the area directly under the fixed magnet when zeros are showing through the counter window. This arrangement will minimize the risk of having the display come to rest unintentionally at zero while preserving the balance of the display cylinder assembly.

Figure 10:
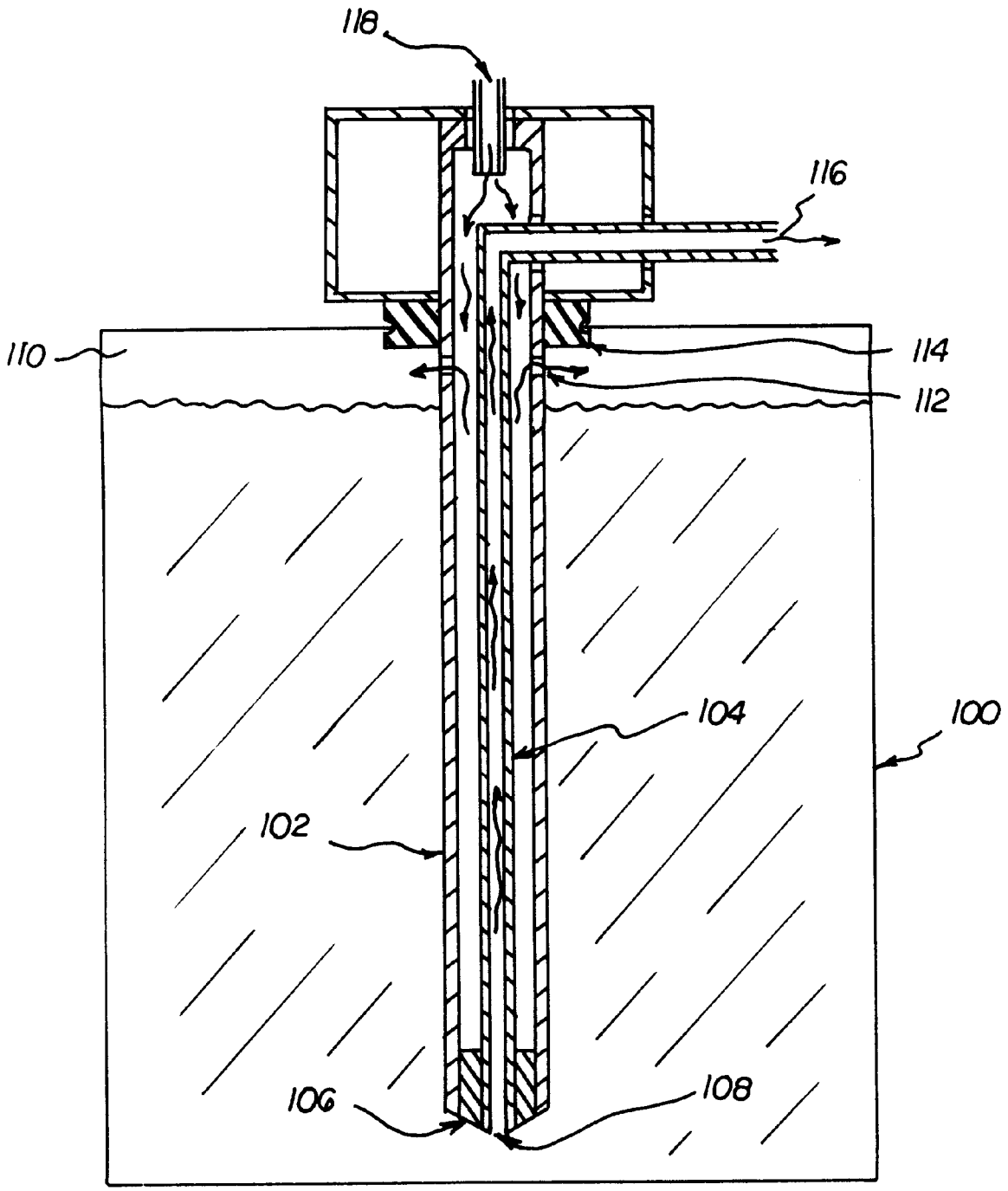
FIG. 10 is a cross-sectional view wherein the container is a mini-keg of beer with modified dispensing mechanisms.
Figure 11:
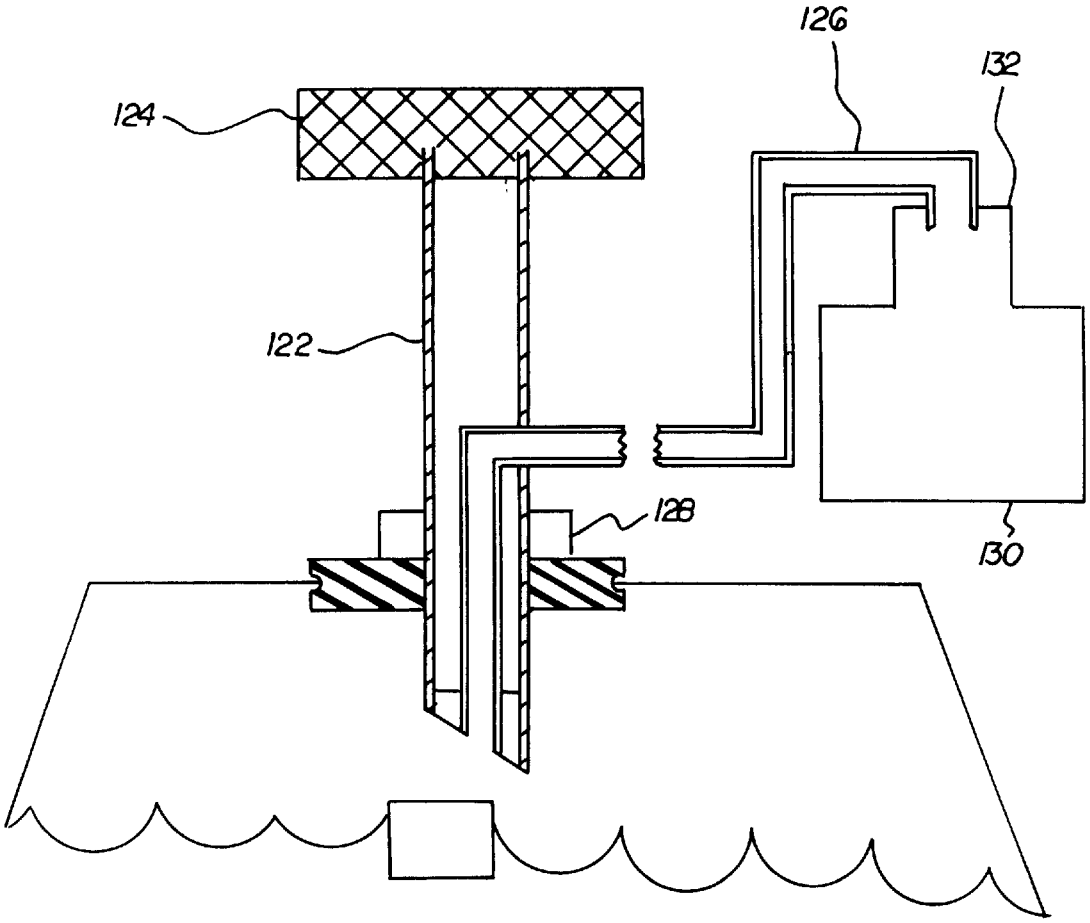
FIG. 11 is an enlarged cross-sectional view of the upper segments of the components shown in FIG. 10.

An alternate embodiment of the device is shown in FIGS. 10 through 14. Such embodiment is adapted for use in dispensing beer from a mini-keg. The creation of pressure inside the mini-keg cannot be avoided due to the nature of the beverage inside and the unavoidable handling and shaking of the mini-keg itself in transit or storage. While it is possible to open the mini-keg with the tap alone, releasing the pressure with the device of the present embodiment first will ease the installation of the tap and avoid the spraying of beer into the environment. Its use is simple: The tip of the opener is brought into place over the plug of the mini-keg seal and the handle is pushed down until the plug is forced out of the mini-keg seal, releasing pressure and a small quantity of beer into a container. When pressure is dissipated, the opener can be removed and the tap may be inserted. As shown in FIG. 10, the key components include the mini-keg 100, the tap tube 102, the fluid tube 104 inside of the tap tube, the pressure seal 106, the opening 108 where beer goes up through the fluid tube, the pressure air chamber 110 above the fluid level, air holes 112, a mini-keg seal 114, the opening 116 where beer comes through for being dispensed, an opening 118 at the top for air pressure to go through. With regard to FIG. 11, there is also shown an opener/pressure release stem 122, a handle 124, an opener/pressure release tube 126, an opener/pressure release depth stop 128 and a container 130 with an air vent 132.

After breaking the seal and releasing pressure, the mini-keg tap is inserted into the mini-keg. When the tap is flush with the mini-keg seal, the air holes are pushed below the mini-keg seal creating a pressurized air chamber above fluid level when pressurized air is introduced into the tap tube's air chamber. Fluid under pressure is forced up and out through the fluid tube.

Figure 12:
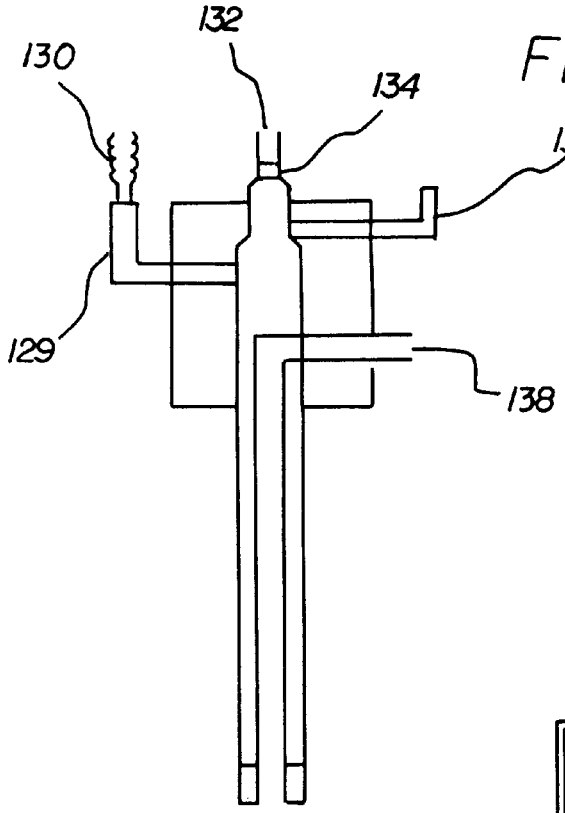
FIGS. 12 and 13 show the central fluid tube and tap tube of FIGS. 10 and 11.
Figure 14:
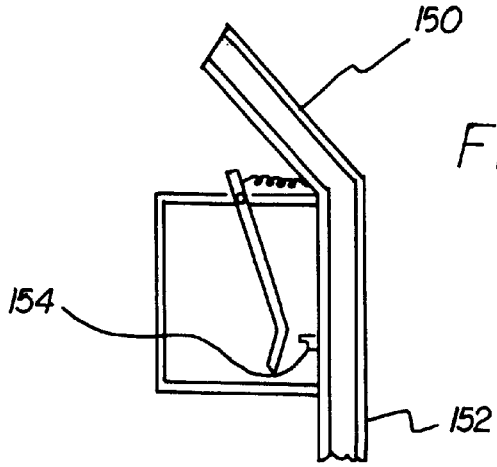
FIG. 14 is a cross-sectional view of the gas pump nozzle without the valve.
Figure 13:
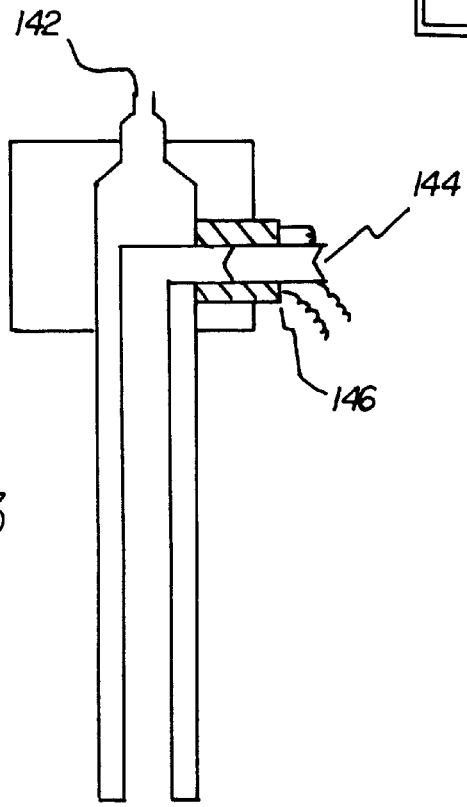

A more elaborate form of the tap is shown in FIGS. 12, 13 and 14. In these embodiments, a more elaborate form of the tap is shown with various features to make the gas pump beer dispenser safer and more automatic, as for example utilizing an autoswitch, relief and check valves. While these features may be incorporated into the gas pump structure, locating them on the tap itself makes maintenance of the unit easier. When the electrically operated solenoid valve is located on the tap, cleaning the dispensing hose with nozzle is easier since the valve replaces the valve inside the nozzle. A simple rinse of water through the hose is all that is needed.

As can be seen in FIG. 12, there are featured a pressure sensitive switch 129 set to shut off the air pump when the mini-keg pressure reaches a predetermined pressure, electrical wires 130 to the air pump, an opening 132 at the top wherein air enters, a one-way check valve 134 to permit air in but prevent the back flow of fluid, a pressure relief valve 136 for safety set to release pressure in the mini-keg if pressure is too high, and an opening 138 from which beer is dispensed.

In the FIG. 13 embodiment, there is an opening 142 at the top for the receipt of air and an opening 144 for the dispensing of beer. There is also an associated solenoid 146 for the beverage which is a solenoid beverage dispensing valve.

FIG. 14 shows a gas pump nuzzle 150 without a valve. In this embodiment, the fluid tube 152 is on the nozzle and, in association therewith, is a switch 154 to operate the solenoid valve on tap and display.

The primary embodiment should be one that would provide a novelty to the public for private use. This embodiment includes the Gas Pump Beer dispenser in combination with the mini-keg and a non-calculating flow dial on the front of the Gas Pump. However in an alternative embodiment more suited for commercial use an accurate flow dial in combination with a conventional flow counting system can be used to precisely measure the amount of beer dispensed.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A beer dispensing system for dispensing beer through an ornate system comprising, in combination:

a housing having an upper end, a lower end, a front wall, a rear wall and opposed side walls, the housing having a hollow interior, the lower end having an outwardly extending stand secured thereto, the front wall having a display disposed thereon, the upper end having a decorative sign extending upwardly therefrom;

a portable beverage container secured completely within the hollow interior of the housing, the beverage container having a cover removably coupled with an open upper end thereof, the beverage container holding a quantity of a carbonated beverage therein;

a pump secured within the hollow interior of the housing, the pump having a tube extending outwardly therefrom and extending inwardly through the cover into the beverage container;

an outlet hose extending outwardly of the beverage container, the outlet hose having an interior end in fluid communication with the carbonated beverage in the beverage container, the outlet hose having an exterior end extending outwardly of one of the opposed side walls of the housing;

an outlet pump coupled with the exterior end of the outlet hose, the outlet pump including a dispensing spout contiguous therewith, the outlet pump including a generally U-shaped handle extending downwardly therefrom, the outlet pump including a one way valve pivotally disposed therein for precluding the flow of carbonated beverage therethrough, a manipulating handle pivotally coupled with the U-shaped handle, the manipulating handle having an inwardly extending portion for selectively raising the one way valve;

a flow counting system including a flow counter wheel disposed within the outlet pump, the flow counter wheel having a wire extending along the outlet hose into the hollow interior of the housing, the flow counting system including a motor disposed within the hollow interior of the housing, the motor coupling with a free end of the wire, the motor having a rotating pulley coupled thereto, the flow counting system including flow counter display disposed above the motor whereby the flow counter display disposed above the motor whereby the flow counter display is viewable through the display in the front wall of the housing, the flow counter display having a rotating pulley, a band extending between the rotating pulleys of the motor and the flow counter display.

2. A dispensing system for dispensing fluid through an ornate system comprising:

a housing having an upper end, a lower end, a front wall, a real wall and opposed side walls, the housing having a hollow interior, the lower end having an outwardly extending stand secured thereto;

a portable fluid container secured with respect to the hollow interior with a cover removably coupled and with an open upper end thereof;

an outlet hose extending outwardly of the container with an interior end in fluid communication with the fluid in the container, the outlet hose having an exterior end extending outwardly of one of the opposed side walls of the housing;

an outlet pump coupled with the exterior end of the outlet hose with a disensing spout contiguous therewith, the outlet pump including a generally U-shaped handle extending downwardly thereform and also including a one-way valve pivotally disposed therein for precluding the flow of fluid therethrough, a manipulating handle pivotally coupled with the U-shaped handle, the manipulating handle having an inwardly extending portion for selectively raising the one way valve; and a flow counting system.

3. The system as set forth in claim 2 wherein the flow counting system includes a flow counter wheel disposed within the outlet pump, the flow counter wheel having a wire extending along the outlet hose into the hollow interior of the housing, the flow counting system including a motor disposed within the hollow interior of the housing, the motor coupling with a free end of the wire, the motor having a rotating pulley coupled thereto, the flow counting system including flow counter display disposed above the motor whereby the flow counter display disposed above the motor whereby the flow counter display is viewable through the display in the front wall of the housing, the flow counter display having a rotating pulley, a band extending between the rotating pulleys of the motor and the flow counter display.

4. The system as set forth in claim 2 wherein the flow counting system includes a hollow deformable elastomeric dome-shaped valve.

5. The system as set forth in claim 2 wherein the fluid is a carbonated beverage.

6. The system as set forth in claim 2 wherein the fluid is beer and the container is a small portable container.

7. The system as set forth in claim 2 wherein the flow counting system includes a flow counter display with a motor and with a belt coupling the motor to the flow counter display.

8. The system as set forth in claim 2 wherein the flow counting system includes a flow counter display with a motor and a solenoid for effecting the movement of the flow counter display.

* * * * *